US005822800A

United States Patent [19]

Anderson

[11] Patent Number: 5,822,800

[45] Date of Patent: Oct. 20, 1998

[54] MULTI-FUNCTIONAL HAT

[75] Inventor: Seth I. Anderson, Grand Junction, Colo.

[73] Assignee: Loki, LLC, Grand Junction, Colo.

[21] Appl. No.: 938,403

[22] Filed: Sep. 26, 1997

[51] Int. Cl.[6] ..... A42B 1/04

[52] U.S. Cl. ..... 2/202; 2/171; 2/209.11

[58] Field of Search ..... 2/171, 173, 202, 2/203, 209.11, 423, 424

[56] References Cited

U.S. PATENT DOCUMENTS

| | | | |
|---|---|---|---|
| 2,998,611 | 9/1961 | Schuessler | 2/202 |
| 3,285,307 | 11/1966 | Dormaier | 150/1 |
| 3,838,467 | 10/1974 | Zientara | 2/202 |
| 4,593,417 | 6/1986 | Brown, Jr. et al. | 2/209.1 |
| 4,641,380 | 2/1987 | Epstein | 2/209.1 |
| 4,776,042 | 10/1988 | Hanson et al. | 2/7 |
| 4,937,885 | 7/1990 | Gregg | 2/196 |
| 5,007,115 | 4/1991 | Denbow et al. | 2/208 |
| 5,109,548 | 5/1992 | Balaban et al. | 2/175 |
| 5,251,336 | 10/1993 | Nevins | 2/202 |
| 5,309,574 | 5/1994 | Balaben et al. | 2/202 |

*Primary Examiner*—Diana Biefeld
*Attorney, Agent, or Firm*—Allen H. Erickson

[57] ABSTRACT

A multi-functional cold weather hat has a tubular fabric body with an open bottom for passage over a person's head. A drawstring channel is formed along the upper edge of the tubular body, and the hat has means for retaining the drawstring at any set position. A domal shaped head covering is sewn into the top of the tubular body. An arcuate face opening is formed in the front of the head covering for exposure of the face therethrough, passage of the head therethrough, or ventilation of the head. The hat is adaptable to be worn in at least six configurations for controllably insulating portions of the head and/or neck.

18 Claims, 10 Drawing Sheets

MULTI-FUNCTIONAL HAT

BACKGROUND OF THE INVENTION

1. Field of the Invention

This invention relates generally to headwear. More particularly, the invention pertains to headwear which may be worn in various configurations to achieve protection against cold and wind under a wide variety of weather conditions and wearer activity.

2. State of the Art

In the pursuit of active winter sports such as skiing, snowboarding, outdoor hockey and ice skating, a major portion of the body's heat loss is from the head. Various types of headwear have been devised for controlling a person's comfort at differing temperature and wind conditions. Typically, the daily range of temperatures at a skiing venue, for example, may be considerable. Thus, at high altitude resorts, the maximum-minimum temperature span during skiing hours may be as high as 60 degrees F. during the day and typically may average about 40 degrees F. The effect of full sun vs. shade may enhance the measured temperature range. Comfort for a skier depends upon a hat which may be quickly adjusted to the current conditions of weather factors (temperature, wind, humidity, precipitation, sun exposure, etc.) as well as the degree of physical exertion.

Current prior art cold weather headwear designs suffer from a number of deficiencies, including an inability to adapt to the varying temperatures and varying levels of activity of the wearer. As an example, prior art ski caps are typically designed to provide a maximum insulative value for a large portion of the wearer's head, but cannot easily be adjusted on the slope to controllably cool a portion of the head during high exertion skiing.

In U.S. Pat. No. 5,007,115 of Denbow et al., a simple tubular garment has a drawstring at one open end. The headwear is limited in the configurations in which it may be used, and it is not designed to be worn simply over the upper portion of the head. The neck is always covered in the disclosed configurations.

U.S. Pat. No. 4,937,885 of Gregg describes a cylindrical head covering, which like that of Denbow et al., has a drawstring at one end for closing it. The head covering is designed to be folded in thirds for narrowing the covered area of the head. While the covering may be worn over the upper part of the head, it provides no option for neck covering, mouth covering, nose covering or full head covering.

In U.S. Pat. No. 4,641,380 of Epstein, an article of headwear is disclosed which may be converted from an upper head hat to a neck covering, requiring its removal, unzippering, inversion and placement over the head in the inverted position. The headwear item cannot simultaneously cover both the head and neck of a wearer. It is not adaptable to covering the nose and/or mouth of a wearer.

A survival cap is described in U.S. Pat. No. 4,593,417 of Brown, Jr. et al. The lower, i.e. earflap portion of the cap may be folded over the upper portion and attached thereto by Velcro® fasteners. In the lower position, the earflap portion covers facial areas including the nose and chin of the wearer. Ventilation of the upper head is not in view.

U.S. Pat. No. 5,251,336 of Nevins discloses a head protector for inclement weather which comprises a hood with a fold-down mouth/nose flap and an integral dickey. This design is limited in that means for ventilating the upper head and the neck are absent. Furthermore, the apparatus is not configured for providing comfort over a wide temperature range such as occurs at high altitude skiing areas. In addition, the head protector is not considered to have the requisite eye appeal for use at stylish ski resorts.

U.S. Pat. No. 2,998,611 of Schuessler shows a cap formable from a tubular body with one closed end and a face opening. The cap may be inverted and the lower portion doubled over the upper portion to reduce the area covered by the cap. It would appear difficult to retain the multiple folding under a high activity level like skiing.

U.S. Pat. No. 3,838,467 of Zientara discloses a cap with a tubular top portion and a bottom face hood portion which telescopes into the top portion. There is no provision for neck protection or top ventilation.

In U.S. Pat. Nos. 5,109,548 and 5,309,574 of Balaban et al., a ski hat is shown which is formed from a flexible laminated fabric cylinder with a closed upper end. The upper end may be drawn together with a drawstring. A face mask is foldable upwardly into the fabric cylinder when not in use. There is no provision for directly ventilating the upper head. The ski hat is provided in three embodiments, for (a) the most severe weather, (b) for somewhat less severe weather, and (c) relatively mild weather.

BRIEF SUMMARY OF THE INVENTION

A primary object of this invention is to provide a cold weather hat which is easily conformable by a wearer to a variety of configurations for achieving maximum comfort over a wide range of temperature and wind conditions and physical exertion.

A related object of the invention is to provide a hat or cap which obviates the need for a skier or other outdoors sportsperson to carry several hats of different thermal values or styles for use during an outing.

Another object of the invention is to provide headwear which may be immediately and quickly changed from one configuration to another while the headwear is being worn, i.e. without removing the headwear.

An additional object of the invention is to provide headwear which provides a controllable degree of ventilation to the top of the wearer's head.

A further object of the invention is to provide an article of headwear which may be alternately worn as a Scandinavian hat, a ventilated Scandinavian hat, a balaclava cap, an open balaclava cap, a neck gator and a raised neck gator.

Another object of the invention is to provide a high-warmth multi-functional hat formable from one or more pieces of fleece type fabric or fabrics.

An additional object of the invention is to provide a multi-functional hat having earflaps with an adjustable chin strap configured to avoid rubbing and chafing of the wearer's neck.

A further object of the invention is to provide a multi-functional hat which in each of its configurations is visually pleasing to the public.

In accordance with the present invention, a multi-function cold weather cap is provided which has a generally tubular body with a drawstring channel at the top periphery of the body. The drawstring permits variable closure of the top end for controlling ventilation to the top of the wearer's head. Attached about the upper inside periphery of the tubular body is a stretchable domal head covering with a face opening adaptable to controllably expose a wearer's eyes, eyes plus nose, eyes plus nose plus mouth, the full face, or the full head. The tubular body may be variably adapted to cover the upper head, the neck, the neck and mouth, or the neck, mouth and nose.

In one embodiment of the invention, the bottom edge of the hat is lobed to provide integral ear coverings or earflaps. Drawstrings attached to the ear coverings may be retained under the wearer's chin by a cordlock or other device to hold the ear coverings against the wearer's ears.

In accordance with the invention, a fabric cord pad encloses a portion of the earflap cords and prevents chafing of the wearer's chin and neck by the cordlock and cords.

The multi-function hat is formed of one or more panels of a generally high thermal insulative value fabric. The preferred fabric is one which in use may be temporarily stretched up to at least about 200–250 percent, i.e. 2× to 2.5× of its original dimension in all planar directions. This high elasticity permits a single size of hat to fit a wide range of head sizes, minimizing the number of hat sizes which must be made, stored and marketed. The high fabric elasticity also enables a change of hat configuration to be more easily performed.

The hat may also be formed of a fabric with less stretchability. Such a hat may not fit as wide a variety of head sizes, however. A hat made of an essentially non-stretchable fabric may lose some of its ability to be retained on the wearer's head, particularly in some configurations.

DESCRIPTION OF THE PREFERRED EMBODIMENTS

Figure 1:
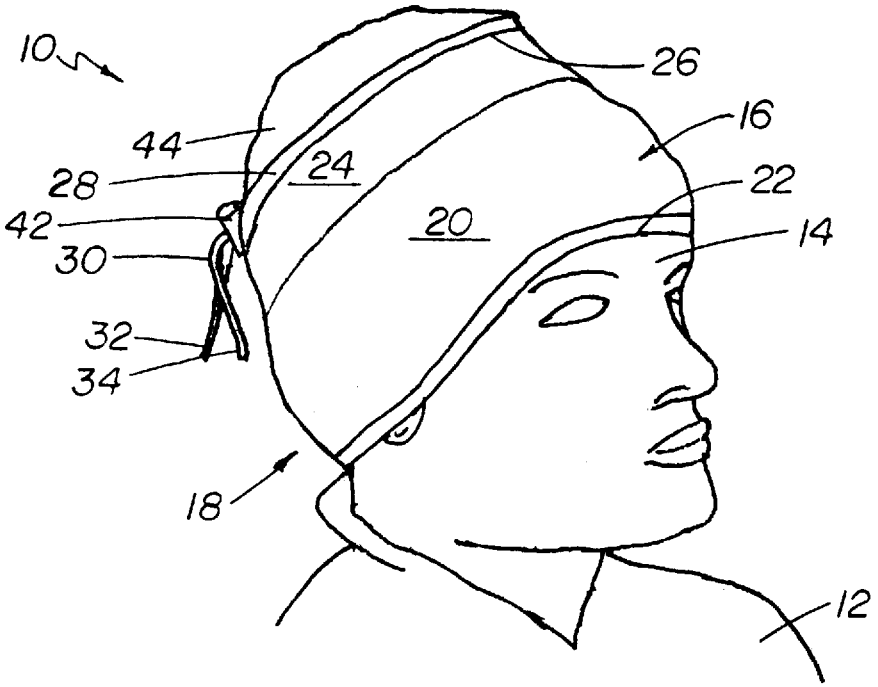
FIG. 1 is a perspective side view of a first embodiment of a multi-functional hat of the invention, as worn in a Scandinavian hat configuration.
Figure 2:
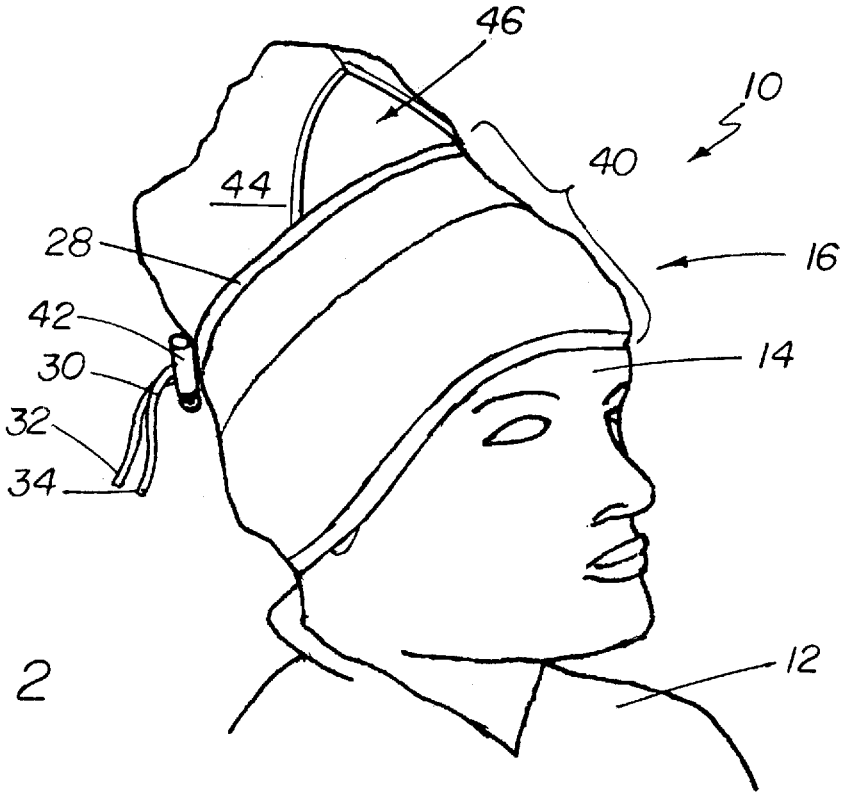
FIG. 2 is a perspective side view of a first embodiment of a multi-functional hat of the invention, as worn in an open top ventilated Scandinavian hat configuration.

With reference to the drawings, and particularly to FIG. 1, a first embodiment of a multi-function hat 10 of the invention is depicted as worn by a wearer 12 in a first configuration having the appearance of a Scandinavian hat. In this configuration, the hat 10 is worn on the upper portion of the wearer's head 14. The hat 10 has a defined front 16 and back 18. The hat 10 includes a lower panel 20 having a bottom edge 22. Above the lower panel 20 and circumferentially attached to it is an upper panel 24. At the upper circumference 26 of the upper panel 24 is a drawstring channel 28 through which a drawstring 30 is passed. The ends 32, 34 of the drawstring 30 exit from the channel 28 through drawstring apertures 36, 38 (see FIG. 6) at the back 18 of the hat 10. The drawstring ends 32, 34 may be drawn to minimize the diameter of the drawstring channel 28. As shown, the draw cord ends 32, 34 pass through a conventional cordlock 42 or similar device to retain the drawstring channel 28 at a desired open condition, or fully closed. The lower panel 20, upper panel 24 and drawstring channel 28 together form a generally tubular body 40 of the hat 10, as shown in FIG. 2.

Attached to the upper panel 24 is a head covering 44 having a generally domal shape when worn as shown. Its shape is conformable to the shape of the wearer's head 14. An arcuate face opening 46 extends upwardly from the drawstring channel 28 on the front of the head covering 44. In FIG. 1, the face opening 46 is tucked into the upper panel 24 to minimize ventilation at the top of the wearer's head 14. As depicted in FIG. 2, the face opening 46 may be partially or fully exposed to permit various degrees of ventilation of the head 14. This is considered to be the ventilated Scandinavian hat configuration.

Figure 3:
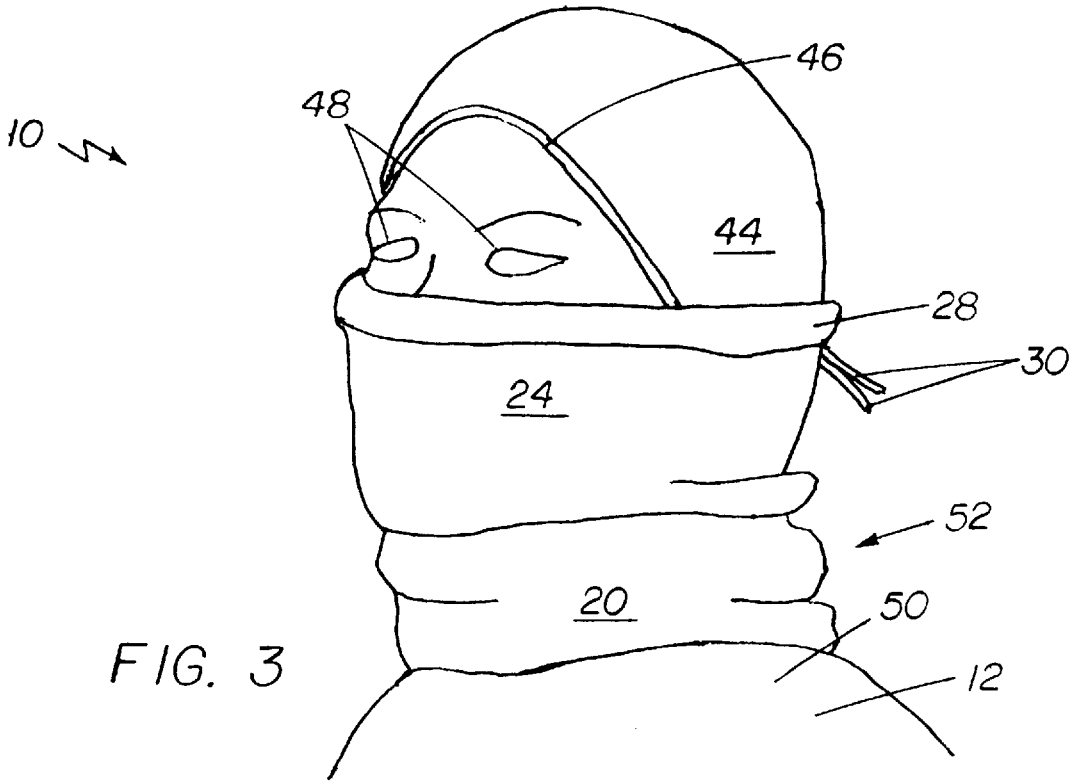
FIG. 3 is a quarter front view of a first embodiment of a multi-functional hat of the invention, as worn in a balaclava configuration.

Turning now to FIG. 3, it is seen that the wearer 12 may pull the tubular body 40 downward over the head 14, wherein the top of the head becomes enclosed in the head covering 44 with the eyes 48 exposed through the face opening 46. In this "balaclava" configuration, the nose and mouth, or mouth only may alternatively be covered by the upper panel 24, as desired by the wearer 12. The lower panel 20 may extend to the wearer's shoulders 50, covering and insulating the neck area 52.

Figure 4:
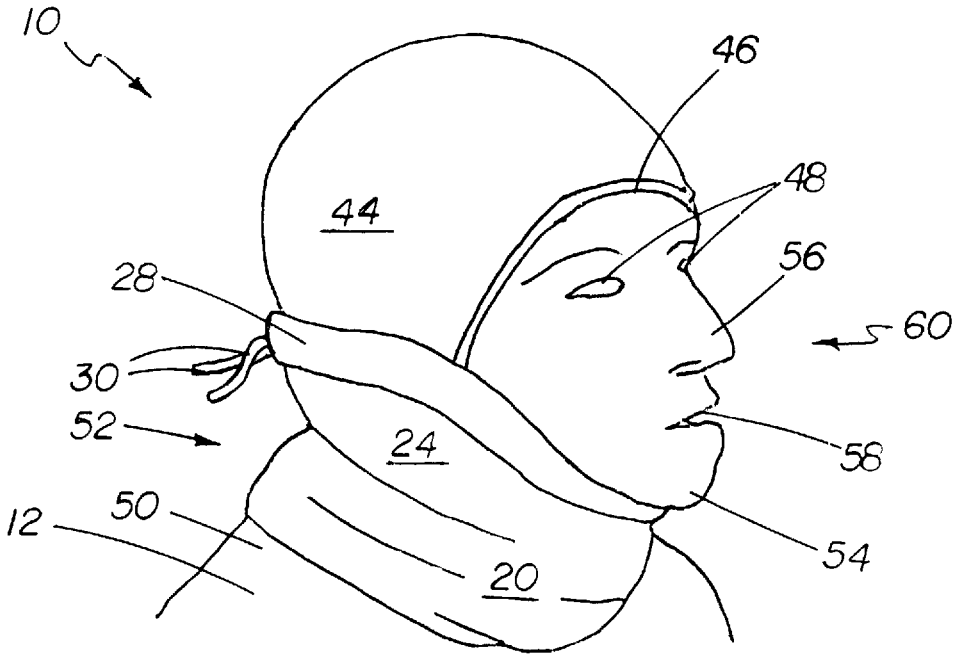
FIG. 4 is a quarter front view of a first embodiment of a multi-functional hat of the invention, as worn in an open balaclava configuration.

In an "open balaclava" configuration shown in FIG. 4, the drawstring channel 28 and attached portions of the upper panel 24 are drawn downward by the wearer 12 to a position under the wearer's chin 54. Thus, this configuration is like that of FIG. 3 except that a major portion of the wearer's face 60 is exposed, including the eyes 48, nose 56, mouth 58 and chin 54.

Figure 5:
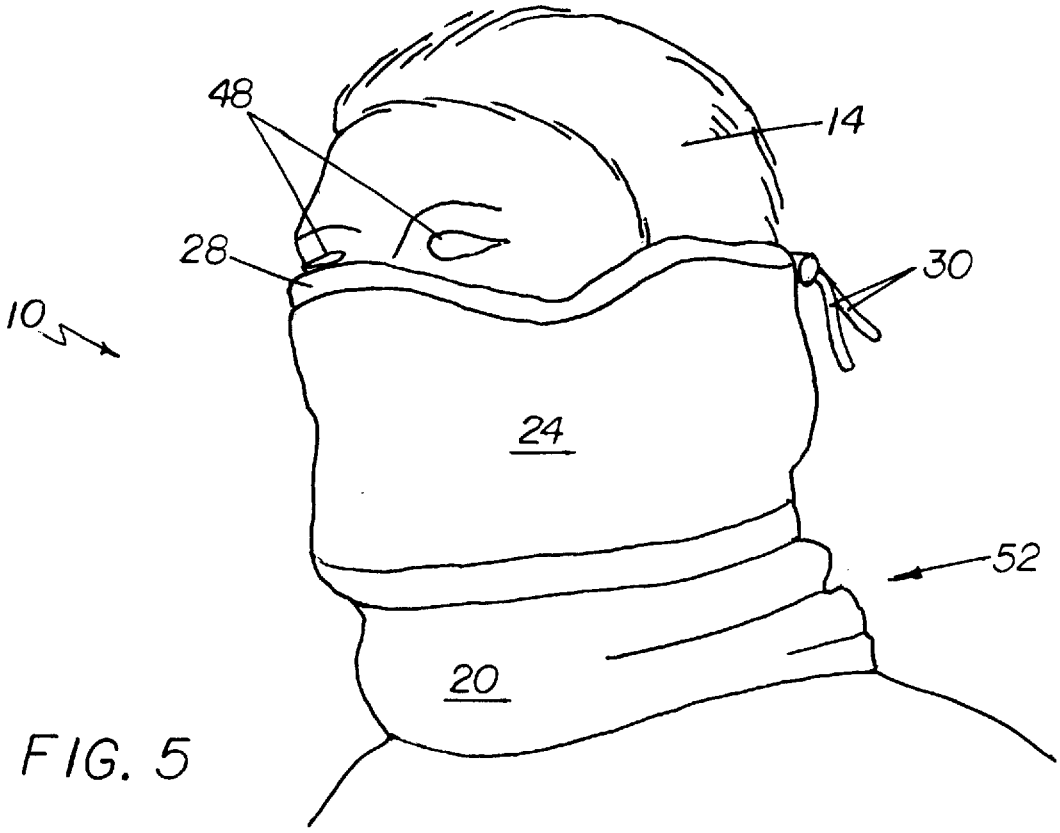
FIG. 5 is a quarter front view of a first embodiment of a multi-functional hat of the invention, as worn in a raised neck gaitor configuration.
Figure 6:
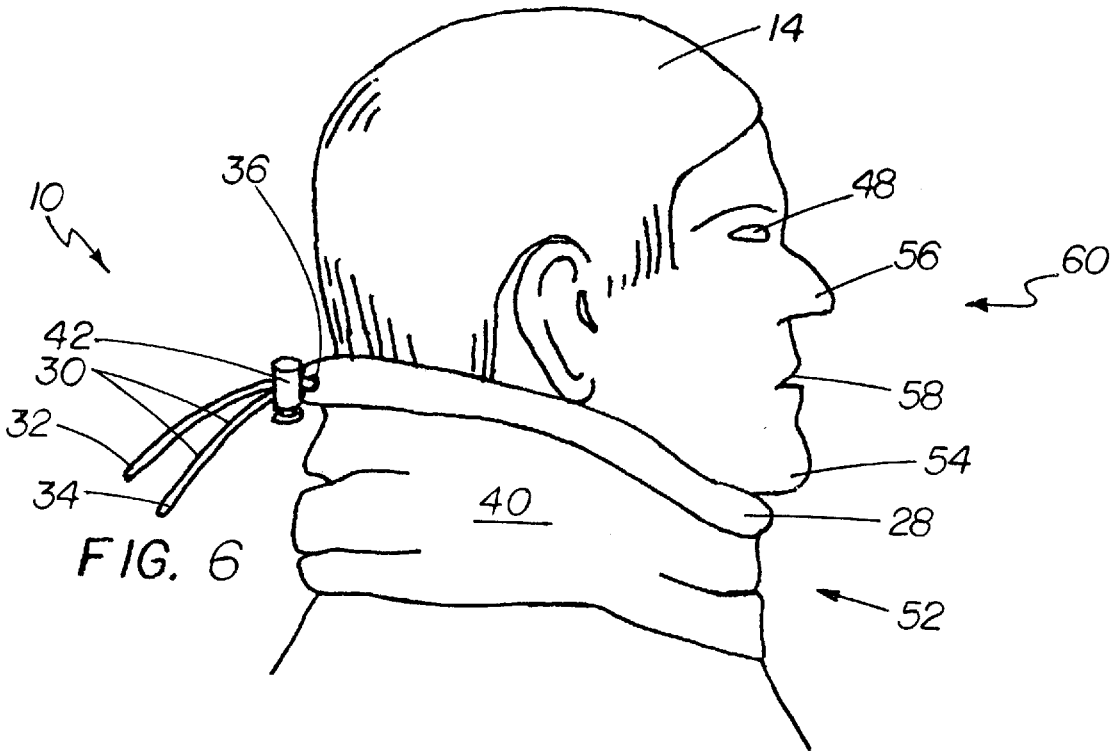
FIG. 6 is a right side view of a first embodiment of a multi-functional hat of the invention, as worn in a neck gaitor configuration.
Figure 7:
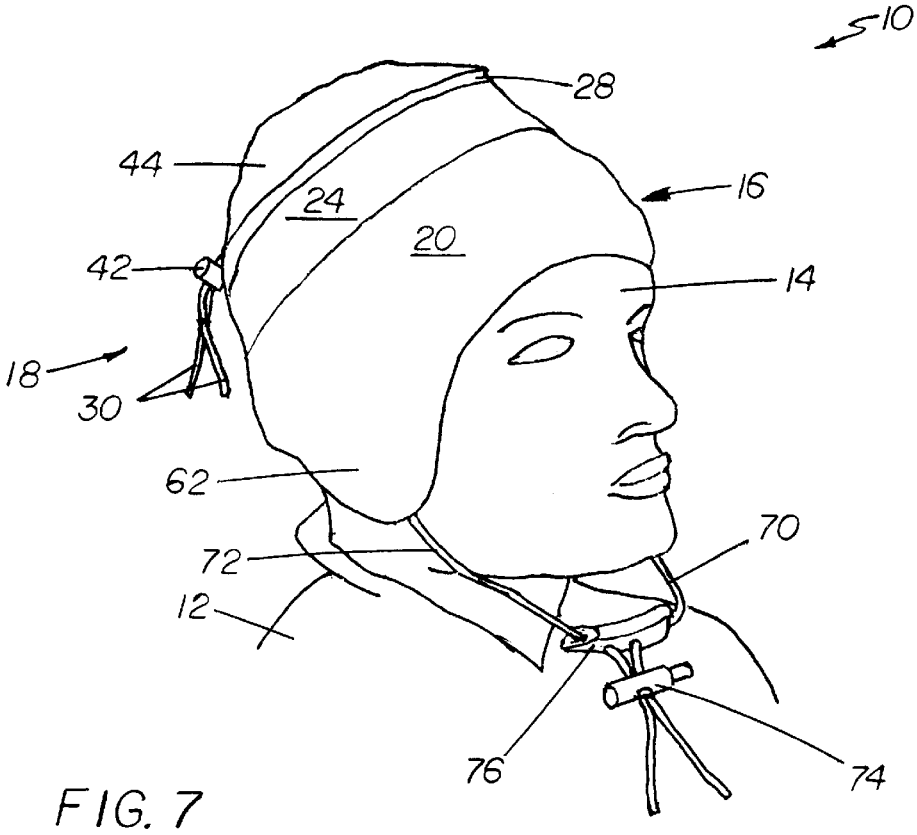
FIG. 7 is a perspective side view of a second embodiment of a multi-functional hat of the invention, as worn in a Scandinavian hat configuration.

As depicted in FIGS. 5 and 6, a portion or the entire head 14 may be pushed upward through the face opening 46 to convert the hat 10 into a raised neck gaiter (FIG. 5) or a neck gaiter (FIG. 6). The raised neck gaiter configuration of FIG. 5 enables the wearer's neck area 52 and the lower portion of the face 60, including mouth 58 and nose 56, or mouth only, to be insulatively covered by the tubular body 40.

By merely pulling the tubular body 40 downward, the gaiter configuation of FIG. 6 is attained, whereby the wearer's neck area 52 only is covered by the hat 10.

Also visible in FIG. 6 is a drawstring aperture 36 through which the drawstring 30 enters the drawstring channel 28. Another drawstring aperture 38 is hidden behind the cordlock 42, by which the drawstring 30 exits the channel 28. Both ends 32, 34 of the drawstring 30 are passed through the cordlock 42 as shown, or other device, for locking the drawstring in a desired position.

Thus, it is seen that the hat 10 may function in at least six different configurations merely by pulling it up or down on the wearer's head, and adjusting the drawstring settings.

A second embodiment of the multi-functional hat 10 is depicted in FIGS. 7–12 as having additional features. The particular functional configurations of the hat 10 are depicted in FIGS. 7 through 12, and are generally similar to those of FIGS. 1 through 6 respectively, i.e. Scandinavian hat, ventilated Scandinavian hat, balaclava, open balaclava, raised neck gaiter, and neck gaiter.

As shown in FIGS. 7–12, the lower panel 20 of this embodiment of the hat 10 has two downwardly projecting lobes 62, 64 which comprise earflaps for the wearer's ears. Chincords 70, 72 are attached to the lower panel 20 near the extremity of left lobe 62 (FIG. 11) and right lobe 64, (FIG. 7) respectively. Where the lower panel 20 comprises two layers of fabric, the chincords 70, 72 may pass into the interlayer space between the fabric layers and be held therein by an enlarged knot, sewing, and/or other means.

The chincords 70, 72 are held together by a spring-loaded chincord cordlock 74 through which the chincords pass. The position at which the chincords 70, 72 are locked in the cordlock 74 may be adjusted by hand, as is well known in the art.

Figure 14:
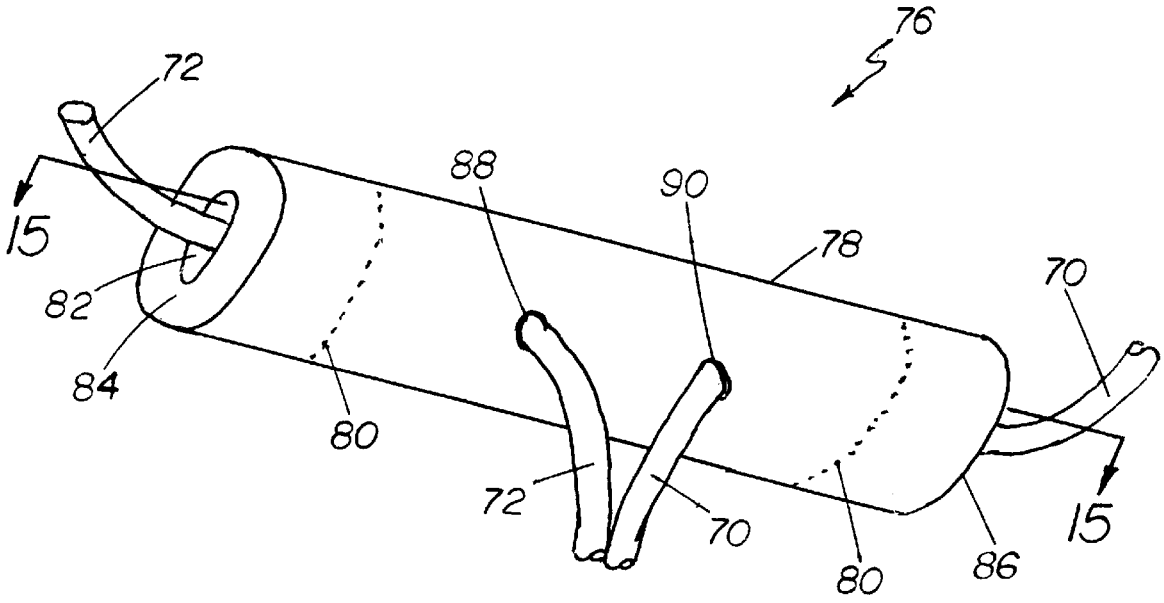
FIG. 14 is a perspective front view of a chin pad of the invention.
Figure 15:
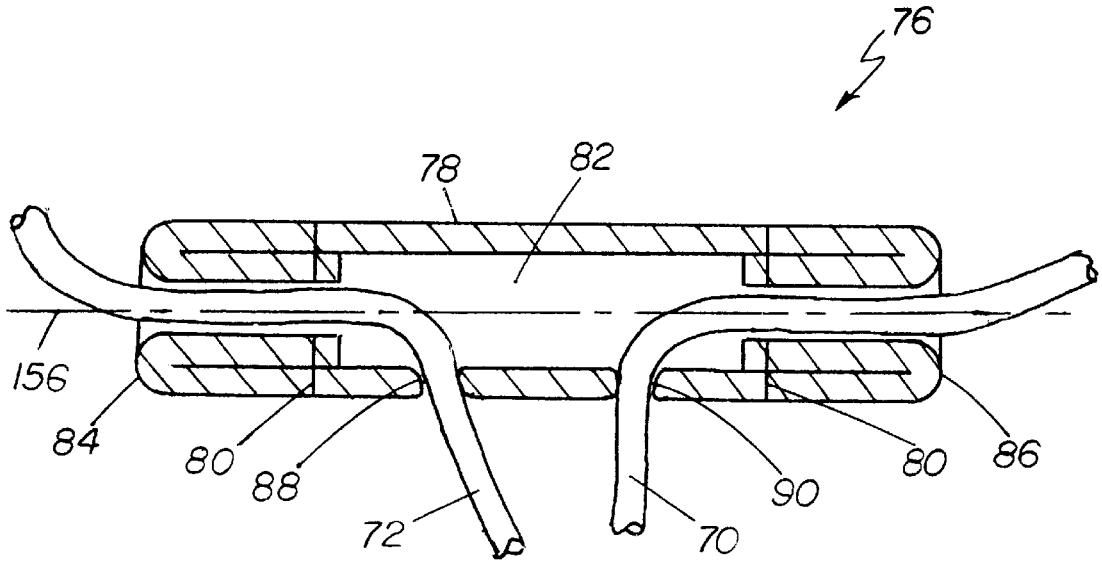
FIG. 15 is a cross-sectional view of a chin pad of the invention, as taken along line 15—15 of FIG. 14.

In accordance with the invention, a chin pad 76 is provided to prevent rubbing and chafing of the cordlock 74 and chincords 70, 72 on the wearer's neck and chin. As depicted in FIGS. 14 and 15, the generally elongate chin pad 76 comprises a tubular member 78 completely formed of a fabric doubled at each end 84, 86 and joined by stitching 80. The chin pad 76 has a hollow core 82 and the ends 84, 86 are open. The two chincords 70, 72 pass from the hat 10 into the open ends 84, 86 and through front apertures 88, 90 to the cordlock. The chincords 70, 72 may be easily adjusted in cordlock 74 to provide a snug fit of the earflaps 62, 64 over the ears without discomfort to the neck or chin.

Figure 8:
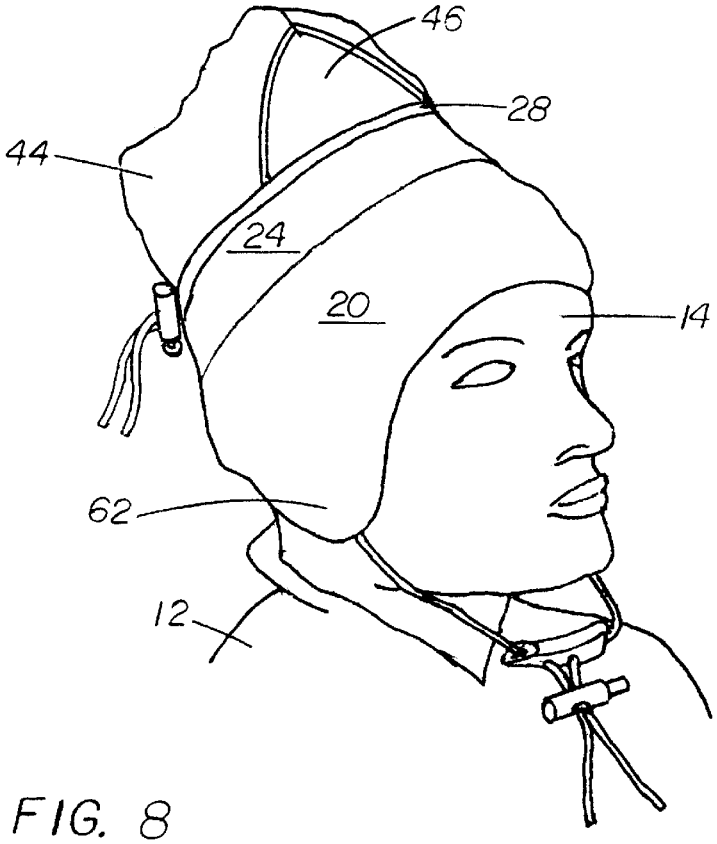
FIG. 8 is a perspective side view of a second embodiment of a multi-functional hat of the invention, as worn in an open top ventilated Scandinavian hat configuration.

FIG. 8 shows the hat 10 with the domal head covering 44 pulled outward to ventilate the upper head through the face opening 46.

Figure 9:
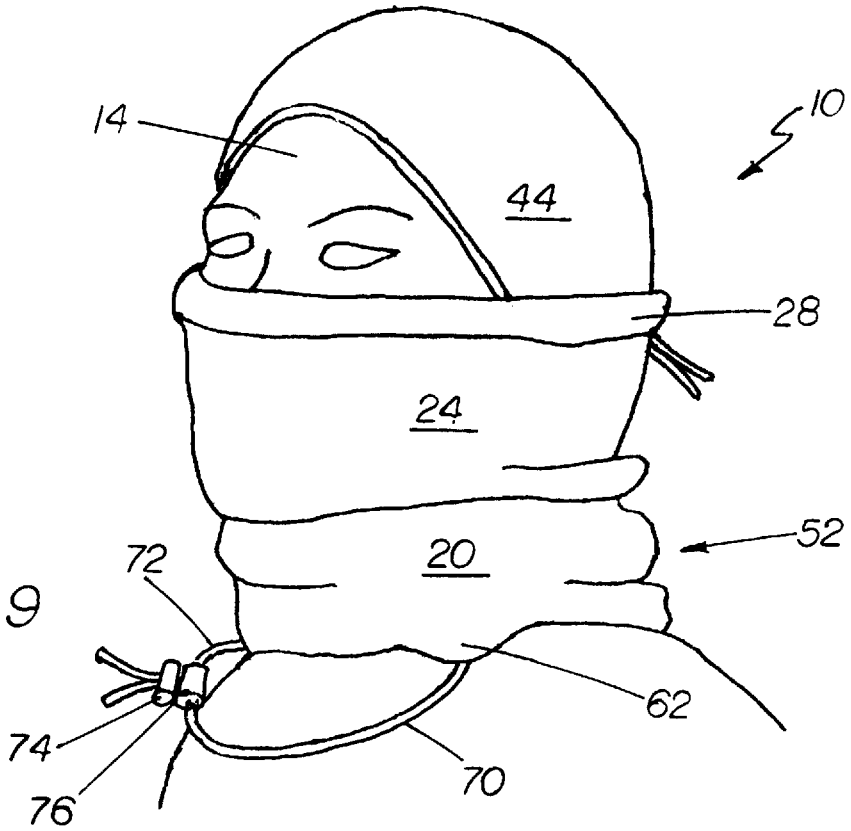
FIG. 9 is a quarter front view of a second embodiment of a multi-functional hat of the invention, as worn in a balaclava configuration.

In FIG. 9, a balaclava configuration is attained by pulling the hat 10 downwardly over the head and neck area 52. The upper and back portions of the wearer's head 14 are covered by head covering 44 and the lower portions of the head 14 and neck area 52 by portions of the tubular body 40.

Figure 10:
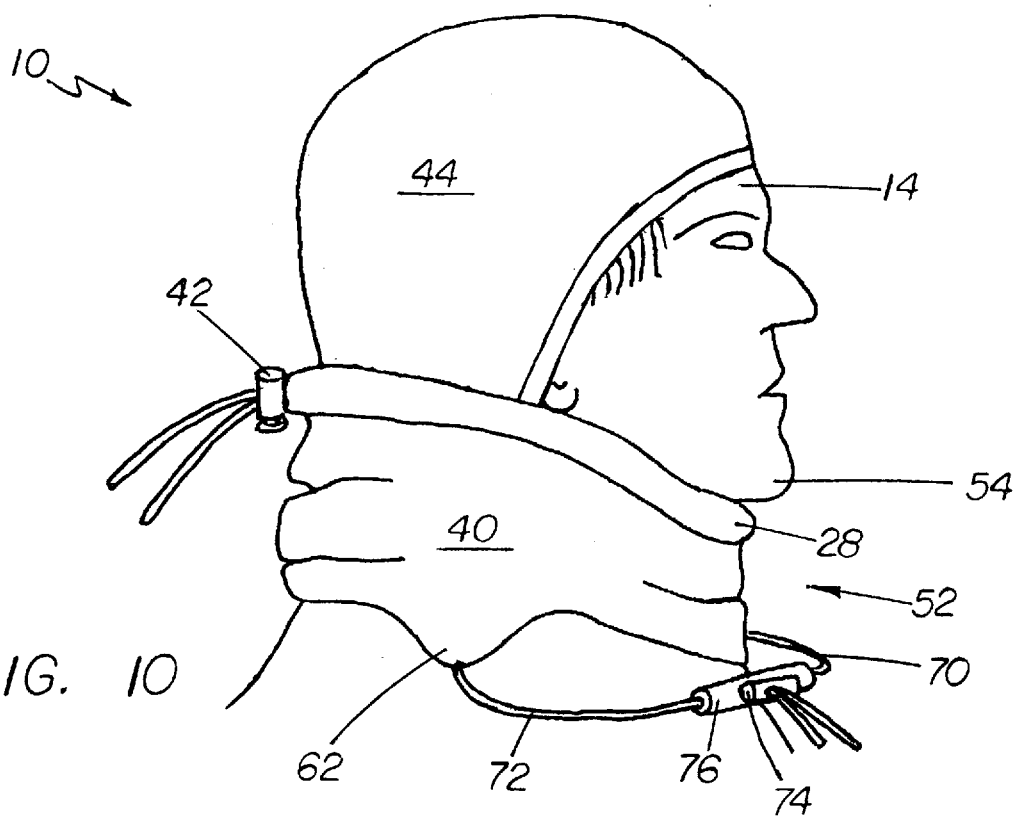
FIG. 10 is a right side view of a second embodiment of a multi-functional hat of the invention, as worn in an open balaclava configuration.

As shown in FIG. 10, the drawstring channel 28 and tubular body 40 may be pulled further downward, to pass beneath the wearer's chin 54. This open balaclava configuration permits most or all of the face 60 to be exposed.

Figure 11:
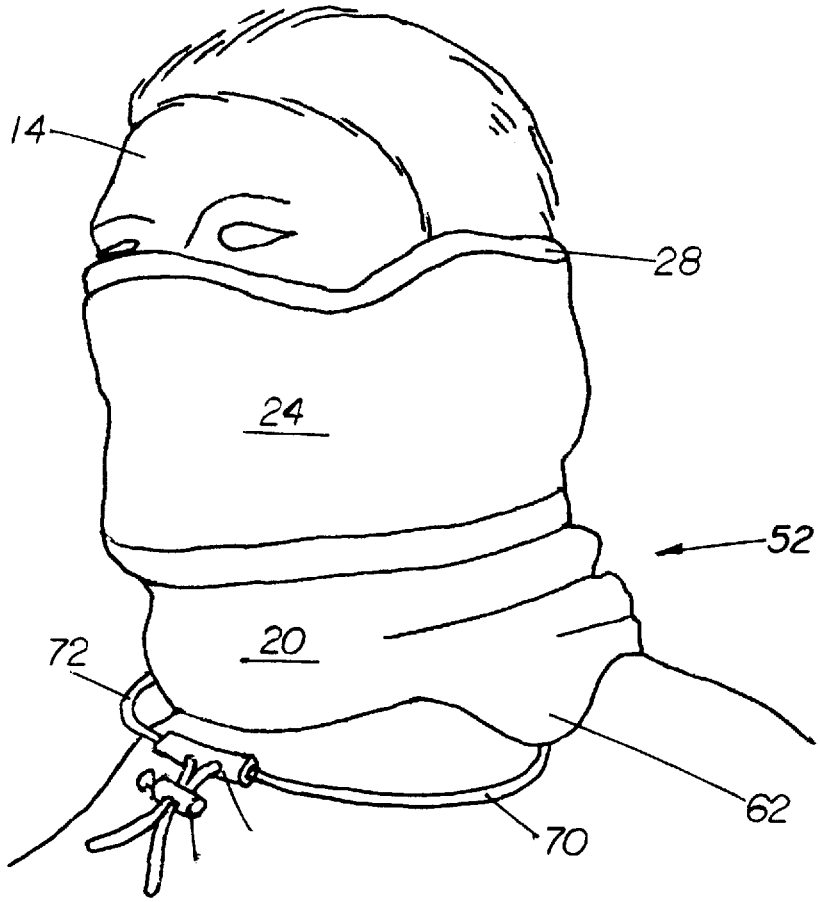
FIG. 11 is a quarter front view of a second embodiment of a multi-functional hat of the invention, as worn in a raised neck gaitor configuration.

As shown in FIG. 11, a raised neck gaiter configuration may be achieved by passing the wearer's head 14 upward through the face opening 46 to expose the upper portion of the head. The head covering 44 is thus positioned in the neck area 52 inside of the tubular body 40. As noted earlier, the tubular body 40 includes the lower panel 20, the upper panel 24 and the drawstring channel 28. The head covering 44 provides additional insulating value to the neck area 52.

Figure 12:
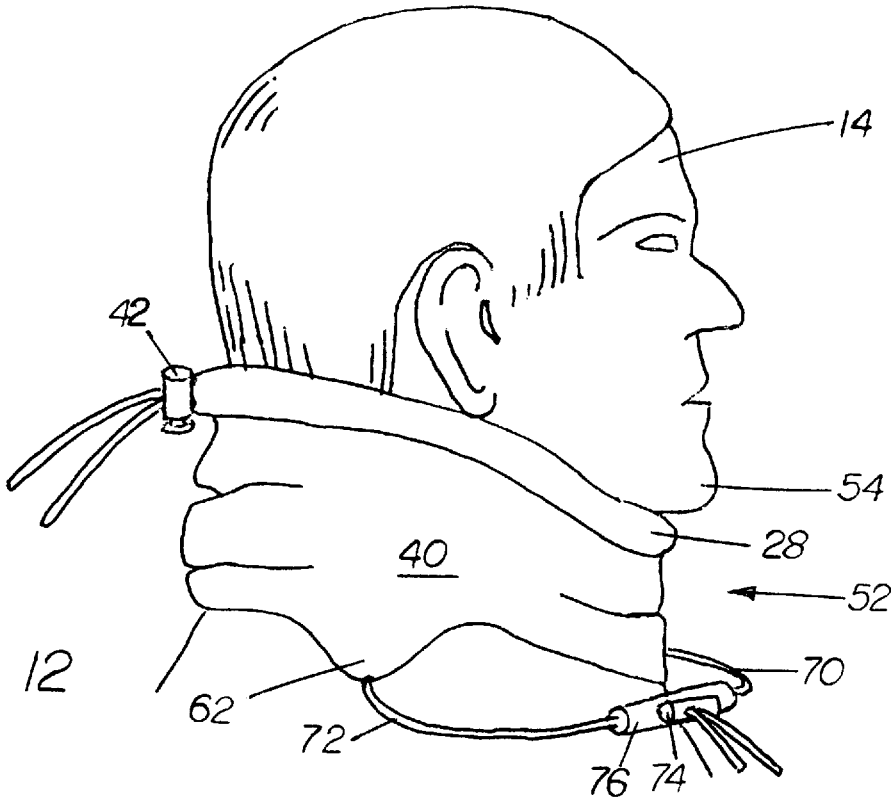
FIG. 12 is a right side view of a second embodiment of a multi-functional hat of the invention, as worn in a neck gaitor configuration.

By pushing the hat 10 further downward to below the chin 54, a simple neck gaiter configuration is formed. This configuration is shown in FIG. 12, and provides concentrated insulative value between the head and the shoulders.

Figure 13:
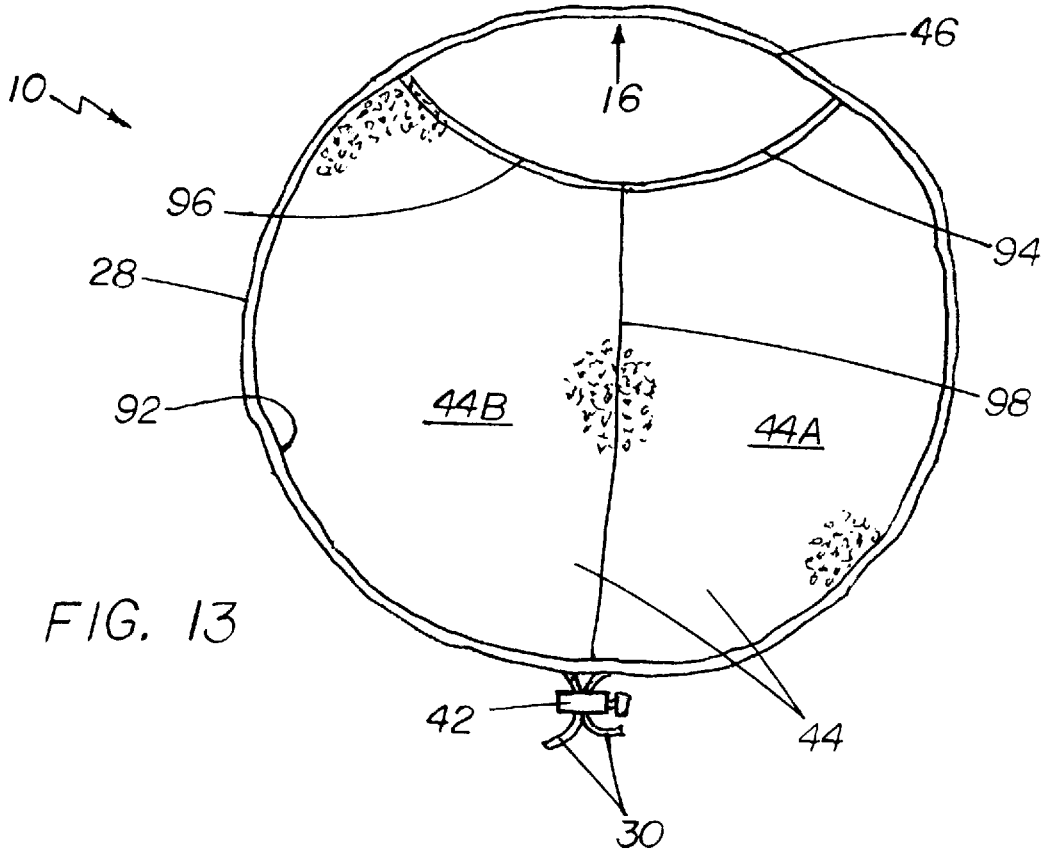
FIG. 13 is a top view of a multi-functional hat of the invention.

FIG. 13 is a top view of multi-functional hat 10, showing a domal head covering 44 which is attached at its periphery 92 to the tubular body 40 below the drawstring channel 28. The head covering 44 is formed in a domal shape from two pieces 44A and 44B of fabric sewn together along seam 98. The face opening 46 in the head covering 44 is positioned at the front 16 of the hat 10, and is bounded by edge 94 of panel 44A, edge 96 of panel 44B and the drawstring channel 28. The domal head covering 44 is typically sized and positioned so that when a wearer's head is fully pushed upwardly into the head covering, the tubular body 40 may be adjusted to completely cover the ears, completely expose the ears, or any intermediate position.

The hat 10, including lower panel 20, upper panel 24, drawstring channel 28 and head covering 44 are formed from a windproof and/or wetproof fabric with high insulative value. In a preferred embodiment, the hat 10 is formed of a polyester fleece material which has high insulative value, may be stretched to over 125% (and preferably at least 200%) of original unstretched dimensions in all directions, and has a natural water resistance. Among commercial versions of this material are those sold under the trademark Polartec. A variety of available fabrics meet the criteria for warmth and stretchability, including Polartec 200 fleece material.

Fleece fabrics with lower stretchability may alternatively be used.

Figure 16:
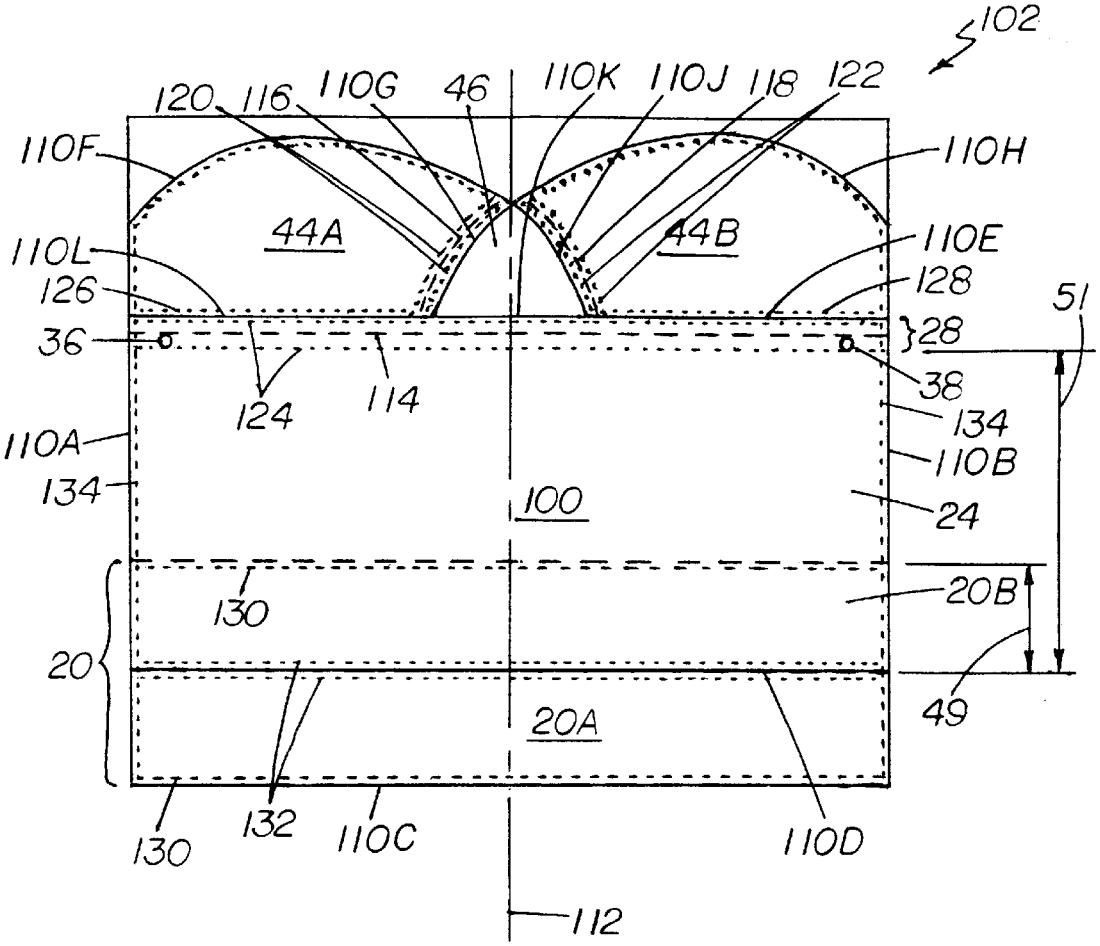
FIG. 16 is a plan view of a pattern for forming fabric pieces to fabricate a first embodiment of a multi-functional hat of the invention.

Turning now to FIG. 16, a pattern 102 is shown for cutting the fabric pieces for forming a multi-functional hat 10 in accordance with the embodiment of FIGS. 1–6. As shown, each of the elements of the hat may be cut as a discrete piece, including right side 44A and left side 44B of the head covering 44, tubular body piece 100 and one layer 20A of the double-layer lower panel 20. The tubular body piece 100 includes the fabric for the drawstring channel 28, the upper panel 24 and a second layer 20B of the double-layer lower panel 20.

The lower panel 20 typically includes two layers of fabric and has a typical vertical dimension 49 of about 1.5 to more than about 5 inches. Of course, the finished vertical dimension may be slightly less because of folding of the fabric edges. For a typical "medium" size hat 10, the vertical dimension of the combined upper panel 24 and lower panel 20 may be about 8–11 inches, and more preferably about 9–10 inches. In an embodiment of the hat 10 having earflaps, described infra, the downwardly extended earflap lobes are not included in the vertical dimension 49 of the lower panel 20.

The pieces 44A, 44B, 100 and 20A of pattern 102 are formed by cutting along cut lines 110A, 110B, 110C, 110D, 110E, 110F, 110G, 110H, 110J, 110K and 110L. The cut lines are symmetrical or nearly symmetrical about center line 112. Although the hat could be made as a single piece of fabric, i.e. without cutting along cut lines 110D, 110E and 110L, the stitching may be performed faster and more precisely using separate pieces of fabric. This is particularly true of the stitching which forms the drawstring channel 28. Of course, the hat 10 may be formed of one piece or more than one piece of fabric. Not only are manufacturing costs less when at least four discrete pieces are sewn together, but there is less waste of fabric.

In general, the stitching is performed so that projecting sewed edges are within the hat, not visible when it is worn. A thread which has high stretchability is used. The particular order of the stitching steps may vary from the following general description.

In forming the hat 10 from the pattern 102, cut lines 110G and 110J are folded along fold lines 116 and 118 and sew lines 120 and 120 are joined by stitching to form a smooth peripheral edge of the face opening 46. Likewise, sew lines 122 and 122 are joined by stitching to form a smooth peripheral edge of the face opening 46.

A drawstring 30 (not shown) is placed along fold line 114 and through each of drawstring apertures 36, 38. Sew lines 124 and 124 are then stitched together to form the drawstring channel 28. The sew lines 126 and 128 of the head covering pieces 44A and 44B may be simultaneously stitched to sew lines 124, or may be separately stitched to the upper panel 24 a short distance below the stitch lines 124.

The lower panel 20 is formed by sewing sub-panels 20A and 20B together. Sew line 130 is joined to sew line 130 and sew line 132 is joined to sew line 132, forming a double layer lower panel 20.

Vertical sew lines 134 are joined, and sew lines 136 of the head covering pieces 44A and 44B are joined.

The ends of drawstring 30 are threaded through a cordlock 42, not shown in FIG. 16, to complete the hat 10.

As shown, the face opening 46 is, when unstretched, somewhat smaller than the head size for which the hat 10 is made. Thus, passage of a wearer's head through the face opening 46 typically requires some stretching of the fabric in the head covering 44 and drawstring channel 28. The fabric typically must be stretched at least to at least about 125 percent of its original non-stretched dimensions, requiring the use of a fabric capable of such stretching. A non-stretch fabric may be used, however, but may limit the hole size for each particular head size.

Figure 17:
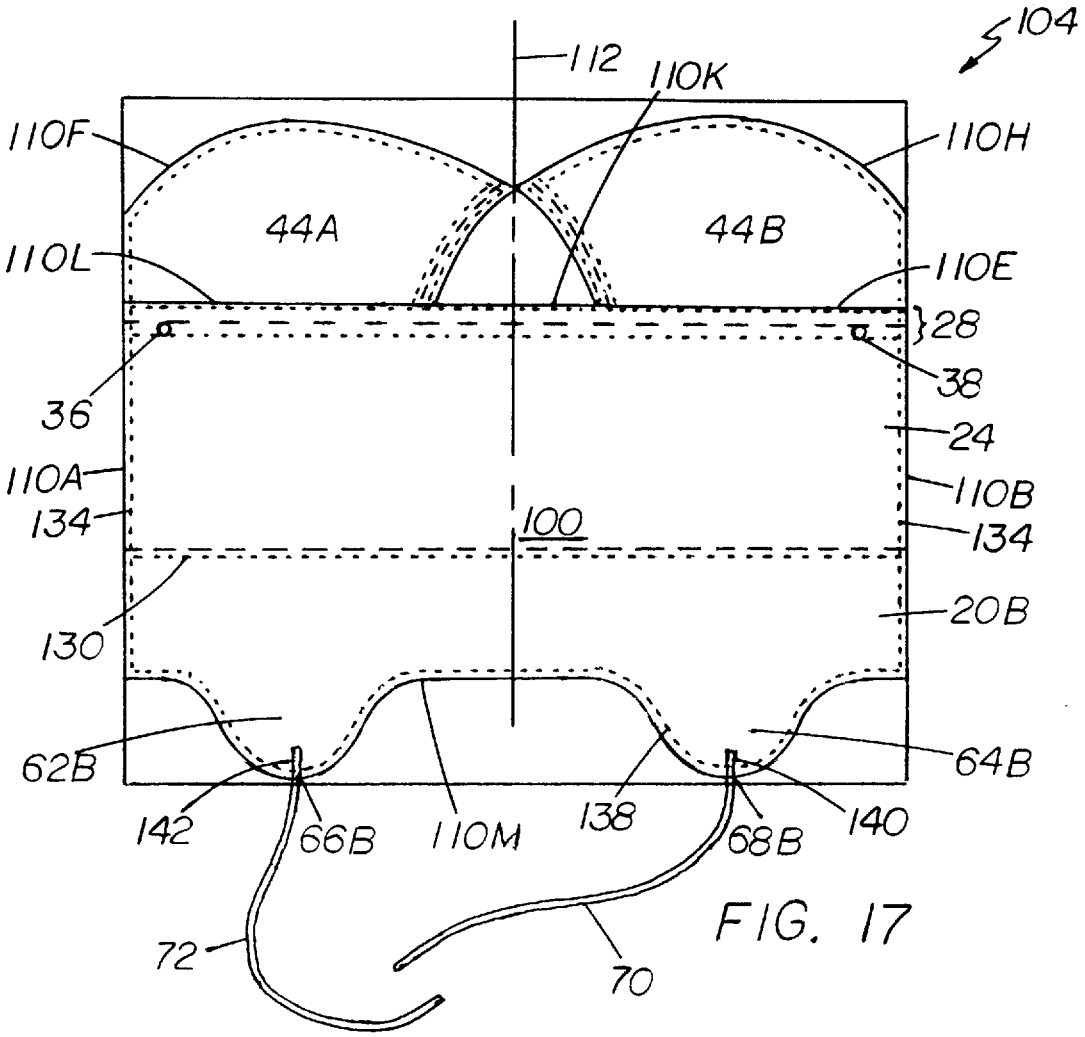
FIG. 17 is a plan view of a pattern for forming fabric pieces to fabricate a second embodiment of a multi-functional hat of the invention.
Figure 18:
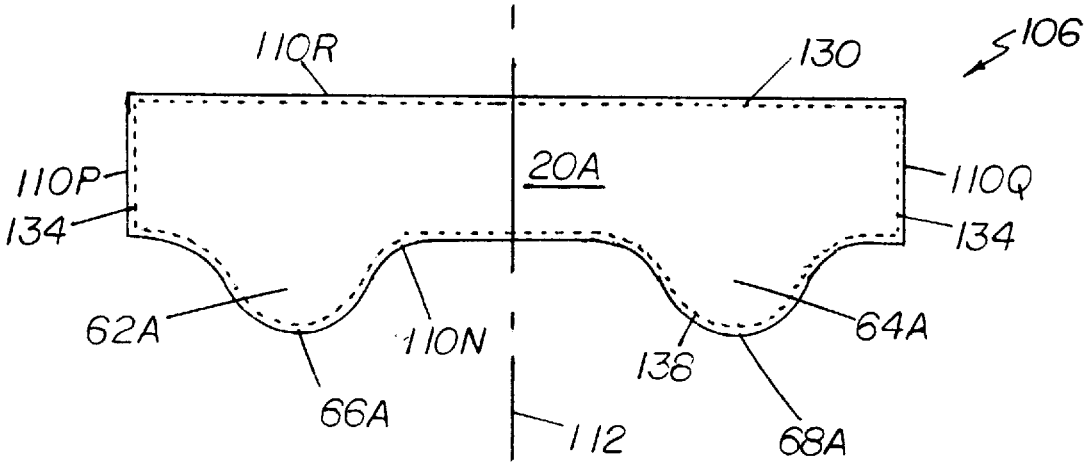
FIG. 18 is a plan view of a pattern of a panel for fabricating a second embodiment of a multi-functional hat of the invention with a double-layered fabric panel.

In FIGS. 17 and 18 are shown patterns 104 and 106 for forming discrete pieces of fabric for constructing the hat 10 shown in FIGS. 7–12. The patterns 104, 106 are generally symmetrical about center line 112. The upper portion of the hat, i.e. the head covering 44 and upper panel 24 are as already described and shown in FIG. 16. Cut line 110M along the bottom periphery of the lower panel 20B of tubular body piece 100 includes downwardly projecting earflap lobes 62B and 64B. A separate lower panel piece 20A having cut lines 110N, 110P, 110Q and 110R is formed to be joined to panel piece 20B by sewing, thus producing a double layered lower panel 20.

The ends 140, 142 of chincords 70 and 72, respectively, are placed between the two panel pieces 20A and 20B at the lobe ends 66A, 66B and 68A, 68B, and joined thereto. The two panel pieces 20A and 20B are joined by stitching sew line 130 to sew line 130 and sew line 138 to sew line 138.

As with the embodiment of FIG. 16, vertical sew line 134 is joined to sew line 134, and the head covering 44 is completed by sewing, to form a tubular hat.

As in the embodiment of FIG. 16, the stitching is generally performed so that projecting sewed edges are within the hat, not visible when it is worn. A thread which has high stretchability is used.

Figure 19:
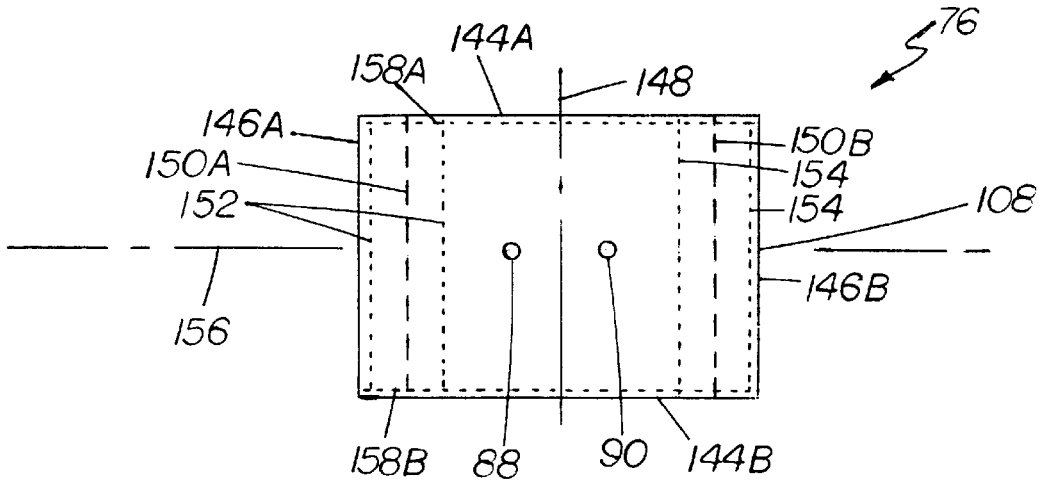
FIG. 19 is a plan view of a pattern for forming a chin pad of the invention.

In FIG. 19, a pattern 108 for forming a chin pad 76 of the invention from a fabric is shown. The chin pad 76 is formed from a rectangular piece of fabric and is generally symmetrical about center line 148. The pattern 108 has opposing sides 144A, 144B and opposing ends 146A, 146B. Drawstring apertures 88 and 90 are formed in the pattern 108, being preferably somewhat spaced apart for passage of drawstrings 70 and 72 therethrough.

The chin pad 76 is formed by folding ends 146A and 146B along fold lines 150A and 150B, respectively, and stitching sew line 152A to 152B, and stitching sew line 154A to 154B. The fabric is then rolled about axis 156 and sew line 158A is joined to sew line 158B by stitching. Axis 156 then passes through a hollow core 82 of the chin pad 76, as depicted in FIG. 15.

The hat of the invention provides numerous advantages over the prior art.

1. The hat is retained on the wearer's head in any of a wide range of configurations. Using a fabric which stretches at least 20 percent, the hat will not fly off or unfold even under very high exertion level exercise, movement at high speed, etc. Even when constructed of a less stretchable fabric, the hat will be retained under such high stress conditions.
2. The hat may be configured in a wide variety of styles, e.g Scandinavian hat, ventilated Scandinavian hat, balaclava, open balaclava, neck gaiter and raised neck gaiter. Each style provides thermal insulation over a different portion of the head and/or neck, enabling the wearer to achieve the most comfortable style for the weather and specific exertion level.
3. The hat is adjustable to a wide range of warmth/ventilation requirements without removal from the head. For example, it may be configured in a variety of ways with one hand, while skiing down a slope.
4. The range of head/neck coverage includes nearly complete head coverage (exposure of eye area only) to coverage of a portion of the upper head only, to neck coverage only.
5. The top of the head may be exposed to a continuum of degrees of ventilation to achieve maximum comfort.
6. The hat is inexpensive to fabricate. It may be formed of one or more pieces of fabric, preferably a polyester fleece fabric such as Polartec, a registered trademark of Malden Mills, or a fleece fabric formed of other materials. A windproof fleece or wetproof fleece may be used, or a combination thereof. Portions of the hat may be formed of two or even three layers of fabric.
7. The hat requires no zippers, snaps or other similar types of fasteners.
8. Where the hat includes lobed earflaps and chin cords to hold the earflaps in place, a chin pad of the invention may be used to cushion the chincord cordlock and prevent chafing or rubbing of the cordlock against the wearer's neck or chin. Thus, the hat is very comfortable under conditions of adverse weather and/or a high exertion level.

It is apparent to those skilled in the art that various changes and modifications may be made to the headwear of the invention as described herein without departing from the spirit and scope of the invention as defined in the following claims.

What is claimed is:

1. A multi-functional hat comprising:

a substantially tubular hat body with an upper edge and a bottom edge;

a tubular drawstring channel formed along said upper edge and encircling said tubular hat body for enclosing a drawstring;

a drawstring positioned in said drawstring channel, said drawstring having opposed ends passing outwardly to exterior said hat body;

a domal head covering attached to the tubular hat body near said upper edge; and an opening in a front portion of said head covering, said opening comprising a face opening.

2. The multi-functional hat of claim 1, wherein said face opening is expandable to at least about 125 percent of its non-stretched size.

3. The multi-functional hat of claim 1, wherein said face opening is expandable to at least about 200 percent of its non-stretched size.

4. The multi-functional hat of claim 1, wherein said head covering is formed of two pieces of fabric joined by sewing.

5. The multi-functional hat of claim 1, wherein said tubular hat body comprises a single layer of fabric.

6. The multi-functional hat of claim 1, wherein said tubular hat body includes a lower panel of two layers of fabric, and an upper panel of a single layer of fabric.

7. The multi-functional hat of claim 1, wherein said lower panel comprises a separate panel member joined by stitching to a first fabric piece comprising an upper panel and a first lower panel portion.

8. The multi-functional hat of claim 1, wherein said drawstring channel comprises a folded and sewn portion of said tubular body.

9. The multi-functional hat of claim 1, further comprising means for adjustably retaining said opposed ends of said drawstring at a desired position.

10. The multi-functional hat of claim 9, wherein said means for retaining said opposed ends of the drawstring comprises a cordlock.

11. The multi-functional hat of claim 1, further comprising a pair of lobes of fabric extending downwardly from said bottom edge, said lobes comprising left and right earflaps for covering the wearer's ears.

12. The multi-functional hat of claim 11, further comprising a chin cord attached to a lower portion of each said lobe, said chin cords configured to be adjustably joined under the wearer's chin.

13. The multi-functional hat of claim 12, further comprising means for adjustably retaining said chin cords together at a desired position.

14. The multi-functional hat of claim 13, wherein said means for retaining said chin cords comprises a cordlock.

15. The multi-functional hat of claim 13, further comprising a chin pad adjacent said retaining means for preventing direct contact of said retaining means with the wearer's neck and chin.

16. The multi-functional hat of claim 13, wherein said chin pad comprises an elongate fabric tube having a hollow core for passage of said chin cords therethrough to a central portion whereby said chin cords pass outwardly from said chin pad to said retaining means.

17. The multi-functional hat of claim 1, wherein said hat body and domal head covering are formed from a highly insulative fabric stretchable to at least about 125 percent of the unstretched dimension in all directions.

18. The multi-functional hat of claim 1, wherein said hat body is formed from a highly insulative fabric with stretchability less than about 25 percent.

* * * * *